United States Patent [19]

Walker

[11] 4,171,018

[45] Oct. 16, 1979

[54] TUBING HANGER ASSEMBLY AND METHOD OF LANDING AND LOCKING

[75] Inventor: Raymond W. Walker, Huntington Beach, Calif.

[73] Assignee: Deep Oil Technology, Inc., Irvine, Calif.

[21] Appl. No.: 887,956

[22] Filed: Mar. 20, 1978

[51] Int. Cl.[2] ..... E21B 23/02; E21B 43/10

[52] U.S. Cl. ..... 166/315; 166/208; 166/196

[58] Field of Search ..... 166/315, 120, 182, 77.5, 166/85, 87, 89, 196, 348, 208, 243; 285/18, 140, 142

[56] References Cited

U.S. PATENT DOCUMENTS

| | | | |
|---|---|---|---|
| 3,163,217 | 12/1964 | Haeber | 166/348 X |
| 3,273,915 | 9/1966 | Bishop et al. | 166/338 X |
| 3,287,030 | 11/1966 | Crain et al. | 285/18 |
| 3,468,558 | 9/1969 | Ahlstone | 285/18 |
| 3,543,847 | 12/1970 | Haeber | 166/208 X |
| 3,603,401 | 9/1971 | Nelson | 166/89 X |
| 3,664,689 | 5/1972 | Hanes | 285/18 |
| 3,688,841 | 9/1972 | Baugh | 166/85 |
| 3,807,497 | 4/1974 | Baugh | 285/18 X |
| 3,933,202 | 1/1976 | Ahlstone | 285/18 X |
| 3,986,729 | 10/1976 | Taylor | 285/18 |

*Primary Examiner*—Stephen J. Novosad
*Attorney, Agent, or Firm*—Poms, Smith, Lande & Rose

[57] ABSTRACT

A tubing hanger assembly adapted to carry a tubing string suspended therefrom and to be connected to a landing tool for lowering of the tubing hanger assembly and tubing string into a well casing means, and landing said tubing hanger assembly on said casing means and simultaneously locking said assembly to said casing means without relative rotation of said landing tool and tubing hanger assembly. A tubing hanger assembly adapted to be releasably connected to a landing tool under conditions where the weight of the landing string is imposed upon the tubing hanger assembly whereby the connection between the landing tool and the tubing hanger assembly is releasable by relative rotation of the landing tool with respect to the tubing hanger assembly in one direction only.

15 Claims, 6 Drawing Figures

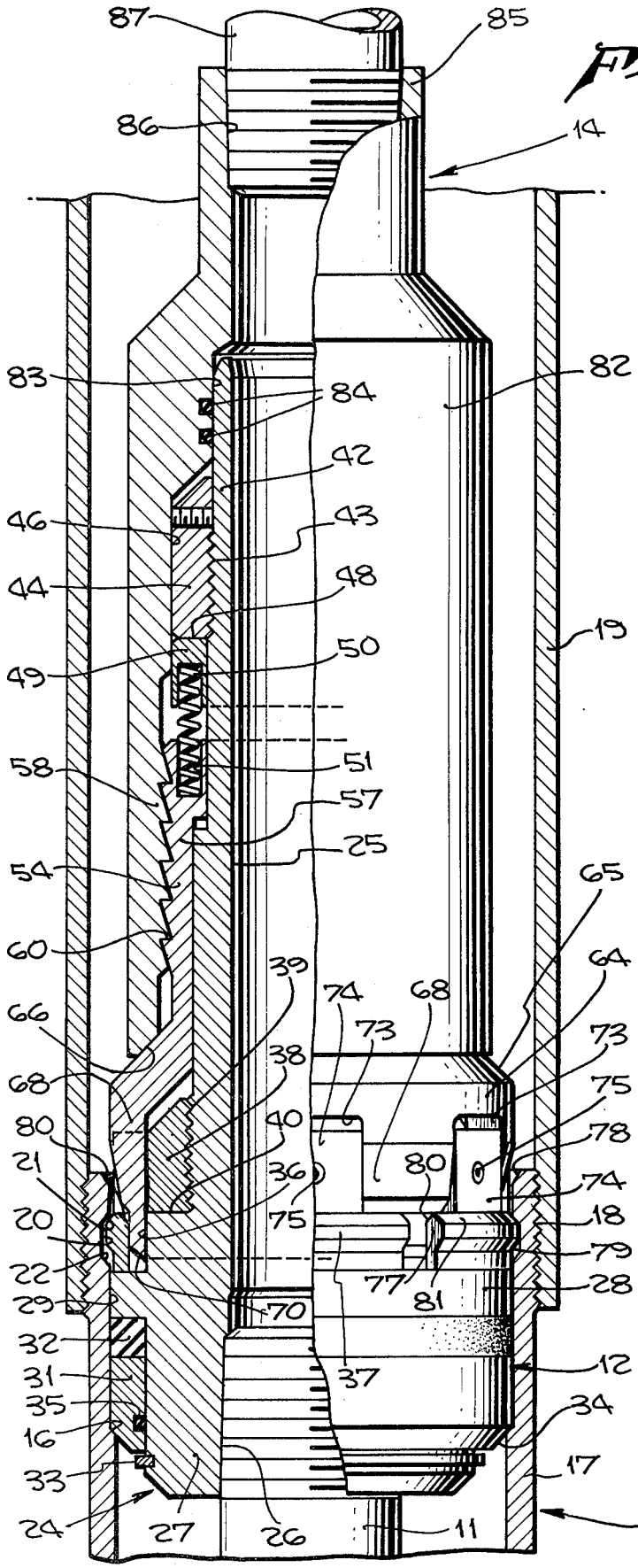
Fig. 4.
Fig. 5.
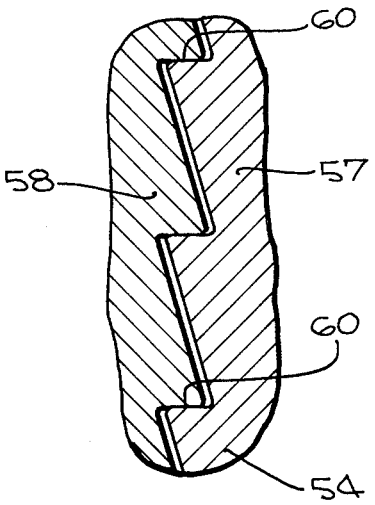
Fig. 6.
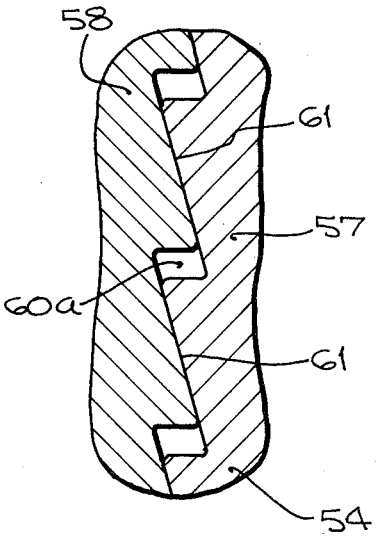

TUBING HANGER ASSEMBLY AND METHOD OF LANDING AND LOCKING

BACKGROUND OF INVENTION

In well operations it is often necessary to provide means for supporting a tubing string within a casing hanger, casing means or other wellhead component. It is desirable that the tubing hanger means which supports the tubing string be locked in its position in the casing hanger or other wellhead component and that the landing string and landing tool used for lowering the tubing assembly be readily and easily disconnected from the tubing hanger assembly. It is also desirable that the tubing hanger assembly be provided with a seal against the casing means in its locked position in the casing means.

Prior proposed tubing hanger assemblies and landing systems having included a variety of constructions for supporting a tubing string in a casing means and for effecting a seal between the tubing hanger assembly and the casing means. In such prior systems, locking of the tubing hanger assembly in the casing means or other well component required either difficult mechanical manipulation of the landing tool or auxiliary hydraulic actuation systems to achieve such locking. Such prior proposed systems were complex, were time-consuming, and in some instances, were likely to create additional problems because during manipulation of the landing tool and string to achieve locking, parts of the landing system might be detached because of the requirement for rotation of the landing tool and landing string. Some examples of hanger assemblies and landing systems are shown in U.S. Pat. Nos. 3,287,030; 3,468,558; 3,603,401; 3,688,841, all of which required rotation of drill pipe, landing string or running tool in order to achieve locking of the tubing hanger assembly with the casing means. An example of a fluid actuated system is shown in U.S. Pat. No. 3,986,729. Utilization of the weight of a running string and drill collars to deform a packing for sealing engagement between the wellhead housing and a hanger is disclosed in U.S. Pat. No. 3,933,202.

SUMMARY OF INVENTION

The present invention relates to a tubing hanger assembly and a method of installing such tubing hanger assembly in a well component such as a casing means, which obviates the disadvantages of the prior proposed systems and which provides a simple effective means for landing, locking, and sealing a tubing hanger assembly in a well casing means.

The present invention contemplates a tubing hanger assembly and a method of landing such assembly in a well casing wherein the landing, locking and sealing of the hanger assembly within the casing means is accomplished by relative linear movement and not by relative rotational movement between elements of the tubing hanger assembly, well casing means, landing tool, and landing tool running string.

The main object of the present invention, therefore, is to provide a novel, unique tubing hanger assembly construction and a novel method for landing, locking and sealing said tubing hanger in a well component.

Another object of the present invention is to provide a tubing hanger assembly and a landing system therefor wherein the weight of a tubing string carried by the tubing hanger assembly is utilized to maintain the connection between the landing tool and the tubing hanger assembly under stress so that relative rotation will not occur.

A further object of the present invention is to provide a tubing hanger assembly construction wherein the assembly is landed on a landing surface in a well casing and is simultaneously locked in the casing means as a result of linear movement of the assembly, landing tool and landing string.

A further object of the present invention is to provide a tubing hanger assembly as described above wherein a lock sleeve member is carried by the hanger assembly and is cooperable with an annular lock ring to positively lock the lock ring in the well casing when weight of the landing string is imposed upon the lock sleeve member.

A still further object of the present invention is to provide a tubing hanger assembly having a lock sleeve member which has threaded connection with a landing tool, said threaded connection having a relative non-rotatable condition when tension forces are applied thereto and having a condition of relative rotation in one direction only when compression forces are applied thereto.

A still further object of the invention is to provide a tubing hanger assembly wherein a packing ring is carried thereby, the packing ring being operably associated with a support ring on the assembly and an annular shoulder on the assembly whereby transfer of weight of the tubing string to the landing surface on a casing means also imposes a compressive force on the packing ring for effecting a seal between the casing means and the tubing hanger assembly.

Other objects and advantages of the present invention will be readily apparent from the following description of the drawings in which an exemplary embodiment of the invention is shown.

IN THE DRAWINGS

FIG. 4 is a fragmentary sectional view of the tubing hanger assembly, well casing means and landing tool with the hanger assembly landed, locked, and sealed.

FIG. 5 is a fragmentary enlarged sectional view of the threaded connection between a lock sleeve member on the tubing hanger assembly and the landing tool and showing said threads under axial compression and free to turn in one direction.

FIG. 6 is a fragmentary enlarged sectional view similar to FIG. 5, but showing the threaded connection under conditions of tension between the landing tool and the lock sleeve member whereby relative rotation therebetween is prevented.

DETAILED DESCRIPTION OF THE PREFERRED EMBODIMENT

Figure 1:
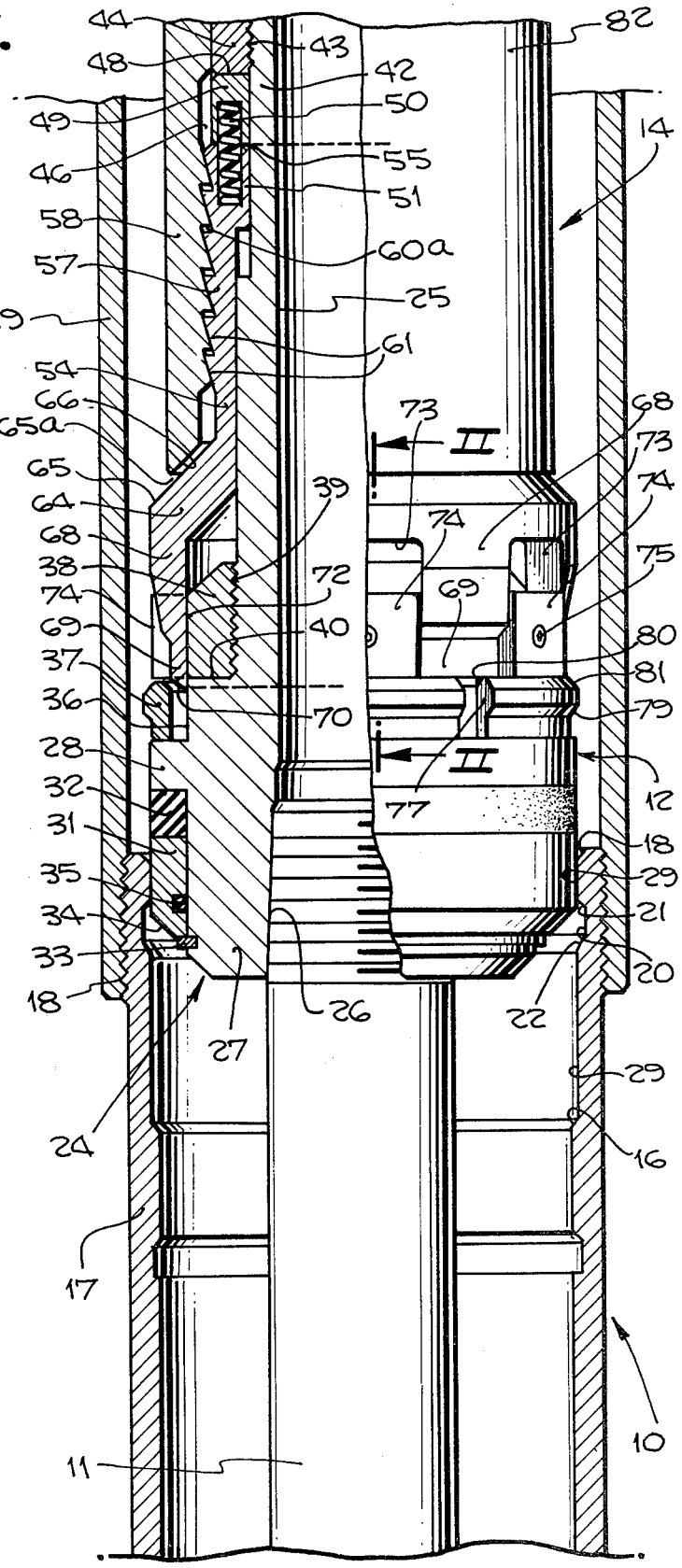
FIG. 1 is a fragmentary sectional view of a tubing hanger assembly carrying a tubing string and connected to a landing tool being run into a well casing means and prior to landing and locking.

In the example of this invention shown in FIG. 1 a well casing means 10 receives therewithin a tubing string 11 connected to a tubing hanger assembly 12 which is connected to a landing tool 14 carried by a landing string (not shown) in well known manner. In offshore well operations the landing string may extend to an offshore platform or vessel and the well casing means or other well component may be located above, at, or below the sea floor.

Well casing 10 is provided with a radially inwardly directed and downwardly inclined landing surface 16 spaced a selected distance below the upper end of casing section 17. The upper end of casing section 17 may be threadedly connected at 18 to an upper casing section 19.

Casing section 17 is also provided with an internal annular locking recess 20 spaced a selected distance from the landing surface 16 and located a suitable distance below the upper end of casing section 17. Annular locking recess 20 is formed with an upper inwardly inclined surface 21 and lower downwardly inwardly inclined surface 22.

Tubing hanger assembly 12 comprises a hanger body 24 having a through bore 25, the lower end of which may be provided with threads for a threaded connection at 26 with the tubing string 11. The lower portion 27 of hanger body 24 is provided with an annular shoulder 28 having an outer diameter to slidably fit within the internal cylindrical surfaces 29 of the upper portion of the casing section 17 above landing surface 16. Below annular shoulder 28 lower hanger body portion 27 has a reduced outer diameter to provide annular space for a support ring 31 and a resilient packing ring 32 each having outer diameters corresponding to the outer diameter of annular shoulder 28. Support ring 31 is held in assembly with lower hanger body portion 27 by a suitable lock ring 33. Support ring 31 is provided with a downwardly and inwardly inclined annular landing face 34 adapted to seat on landing surface 16 of casing section 17. Support ring 31 may be provided with an O-ring type seal 35 for engagement with the lower body portion 27. Support ring 31 is provided limited sliding engagement with body portion 27 between lock ring 33 and the compressed resilient packer 32 upon landing of the tubing hanger on the well casing.

Above annular shoulder 28 the hanger body 24 is provided with stepped reduced diameters to form an annular recess 36 for annular lock ring 37 and an enlarged annular space for a collar 38 having threaded engagement at 39 with threads on the hanger body 24. Collar 38 may be threaded on the body 24 until it is seated on annular surface 40.

Upper portion 42 of the tubing hanger body 24 is provided threaded connection at 43 with an annular retainer 44 which has an outer cylindrical surface or diameter receivable within the hollow chamber 46 of landing tool 14. Retainer 44 provides a seat at 48 for a spring receptor 49 adapted to receive and position upper ends of a plurality of circumferentially spaced spring members 50. The lower end of spring members 50 are received within recesses 51 formed on the upper end portion of a lock sleeve member 54.

As seen in FIG. 1 when the tubing hanger means 12 is carrying tubing string 11 and the weight of the tubing string is transferred through the hanger body 24 to the upper portion 42 of the hanger body, the plurality of spring members 50 will be under compression and edge surfaces of the spring receptor 49 and the upper portion 51 of the lock sleeve member 54 will be in abuttment as at 55 as later more fully described.

Lock sleeve member 54 is provided with a threaded portion 57 below its upper portion 51 for engagement with a threaded portion 58 on the landing tool 14. The thread configuration of the threaded interconnection between portions 57 and 58 is best shown in FIGS. 5 and 6. In FIG. 5 the relative axial position of the threaded portions 57 and 58 when the portions are under axial compression provide sliding helical contact at 60 between radially disposed tooth faces on the lock sleeve member portion 57 and on the landing tool portion 58. Under such condition of axial compression it will be readily apparent that the landing tool may be rotated relative to the lock sleeve member.

In FIG. 6 the lock sleeve member threaded portion 57 and the landing tool threaded portion 58 are disposed under a condition of relative axial tension in which the axially sloping faces of the threaded portions are in frictional engagement at 61. Under conditions of axial tension the sloping interengagement at 61 provides a wedge effect whereby the two members become relatively non-rotatable. The condition of the threaded interconnection shown in FIG. 6 corresponds with that shown in FIG. 1 and the relatively rotatable condition of the threaded portions as shown in FIG. 5 corresponds with that shown in FIG. 4.

Figure 3:
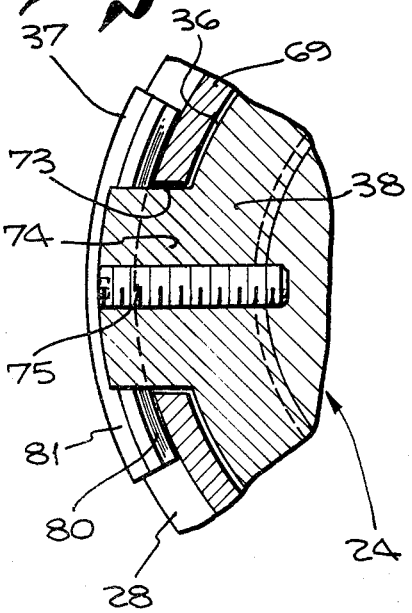
FIG. 3 is a fragmentary sectional view taken in the plane indicated by line III—III of FIG. 2.

Lock sleeve member 54 includes a lower radially outwardly flared portion 64 having an exterior conical surface 65 spaced as at **65*a* from a coresponding internal conical surface 66 on the lower end of landing tool 14 in the condition shown in FIGS. 1 and 6. Space 65*a* corresponds to the clearance at 60*a*, FIG. 6 when the lock sleeve member and landing tool are under axial tension cooperable with a corresponding internal conical surface 66 on the lower end of the landing tool 14. Below the outwardly flared portion 64 the lock sleeve member is provided with a plurality of circumferentially spaced arcuate lock elements 68 which include radially inwardly reduced lock extremities 69 having a lower beveled edge 70. Lock elements 68 have an inner surface slidable in an axial direction on the exterior surface of lock ring 38 as at 72. Circumferentially spaced lock elements 68 are received within circumferentially arranged spaces 73 defined by arcuate lugs or projections 74 integral with collar 38. A headless set screw 75, FIG. 3 may be threaded through each lug 74 to extend into body 24 after collar 38 has been threaded into abutment with shoulder surface 40. Collar 38 is thus positively held against turning or unthreading with respect to body 24**.

Annular lock ring 37 is split at 77, the space between the split ends of the ring 37 permitting the ring to radially contract so that its contracted diameter will permit the ring to pass into the open end of the upper portion 17 of the well casing. For this purpose the well casing 17 has a tapered internal face 78 which is engageable by a corresponding conical face 79 on ring 37. The upper inner circumferential edge of ring 37 is also provided with a conical tapered face 80 which is cooperable with the tapered or conical face 70 on the lock sleeve member element 68.

Landing tool 14 includes a cylindrical body 82 providing the hollow chamber 46 and having a reduced bore 83 for reception of the upper end of the tubing hanger body 24. A pair of O-ring type seals 84 carried by the cylindrical body 82 slidably engage the upper end portion 42 of the hanger body. Landing tool 14 is provided with a conventional type threaded tubing box 85 for threaded connection at 86 to a landing or running string 87, FIG. 4.

In the method of landing, simultaneously locking, and simultaneously sealing the tubing hanger body 12 within a well casing 10 or other well component reference is first made to FIG. 1. In FIG. 1 tubing string 11 is suspended from the tubing hanger assembly 12 which through the threaded engagement means of the lock sleeve member and the landing tool 14 is adapted to be lowered into the well casing 10. In such lowering condition the engagement means of the landing tool and lock sleeve member are in tension as shown in FIG. 6 because of the weight of the tubing string 11 and the landing tool is thereby non-rotatable relative to the tubing hanger assembly 12. In such tension condition the spring members 50 are under compression and the edge faces of the lock sleeve member and the spring member receptor 49 are in abuttment at 55 because of the relative movement axially between the tubing hanger body, the lock sleeve member 54, and the lock sleeve member relative to the landing tool 14. In such lowering condition it should also be noted that the lock members 69 on the lock sleeve member 64 are located upwardly of the annular lock ring 37 which is carried by the tubing hanger body in radially expanded condition.

As the tubing hanger body 27 enters the upper portion 17 of the well casing, the conical face 34 on the support ring will cooperate with the internal beveled face 78 on the upper casing portion 17 to guide and facilitate entry of the tubing hanger into the casing portion 17. As the tubing hanger is lowered relative to the casing portion 17, the tapered conical face 78 will be engaged by the downwardly conical face 79 of the lock ring 37 which will cause the lock ring to contract until its outer diameter will be approximately that of the inner diameter of the upper well casing portion 17 as indicated at 29. The contracted lock ring 37 slides on the internal surface 29 above lock recess 20 until ring 37 expands into the recess 20.

The spacing on the tubing hanger body 24 of the lock ring 37 and the landing surface 34 is approximately the same as the spacing of the landing surface 16 on the casing portion 17 from the annular lock recess 20 in the casing portion 17. Thus when the tubing hanger body 24 is landed on the landing surface 16, the lock ring 37 will be opposite the lock recess 20 and will resiliently expand into the lock ring recess automatically upon such landing of the tubing hanger assembly on the casing means.

Upon landing of the tubing hanger assembly 12 on the casing means 10, the support ring member 31 will transfer the weight of the tubing string and tubing hanger body to the well casing means. Upon such transfer of weight it will be apparent that the tubing hanger body 24 will move slightly relative to the support ring 31 and compress the resilient packing ring 32 between the annular shoulder 38 of the body 24 and the support ring 31. Thus, approximately simultaneously with the landing and the expansion of the lock ring 37 into the lock recess a seal is provided between the well casing portion 17 and the tubing hanger body 24.

Locking of the annular lock ring 37 in its expanded position in the lock recess 27 is accomplished by permitting the weight of the landing string 87 to be transferred through the landing tool 14 to the lock sleeve member 54 at the conical surface 65 which becomes engaged by the lower end surface 66 of the landing tool. Upon imposition of such weight, it will be apparent that the lock sleeve member 54 moves relative to the tubing hanger body and the lock elements 69 of the lock member 68 are moved downwardly between the tubing hanger body 24 and the inner cylindrical surface of the annular lock ring 37. The lock sleeve member thereby positively prevents contraction of the lock ring member by the interposing of the plurality of lock elements 69 behind the lock ring 37.

In this condition of the landing tool and tubing hanger assembly, it will be apparent that the spring members 50 are relieved of compression and that the threaded engagement portion 54 of the lock sleeve member has moved relative to the landing tool engagement portion 58 so that the threads are now under a compression condition as shown in FIG. 5. Under such compression condition, the landing string 87 and landing tool 14 connected thereto may be rotated in a counterclockwise direction to unthread the landing tool from the lock sleeve member and from the tubing hanger assembly 12. Release of the landing tool from the tubing hanger assembly is thus readily accomplished. The tubing hanger assembly 12 remains in landed, locked and sealed relation with the well casing and in support of the tubing string 11.

After relief from the weight of the landing tool and string and after the landing tool is removed, the spring members 50 exert a spring force on the lock sleeve member which retains the lock elements 69 behind the lock ring 37 to maintain locked condition of the lock ring 37.

Figure 2:
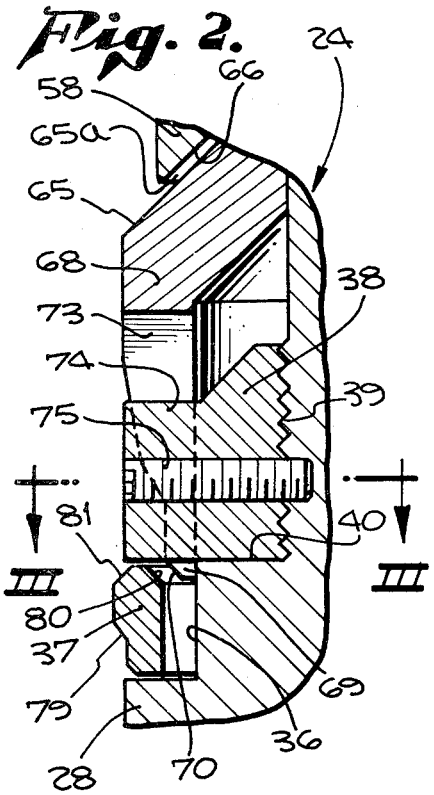
FIG. 2 is a fragmentary enlarged sectional view taken in a radial plane indicated by the line II—II of FIG. 1.

In the event the tubing hanger assembly 12 is desired to be removed from the well casing means landing tool 14 may be reengaged with the lock sleeve member by threading the lock sleeve member thereon by right hand relative rotation until the interengaging threaded portions are substantially reengaged as shown in FIG. 4. When an upwardly directed force is applied to the landing string 87 and landing tool 14, the threaded engagement portions will be placed under relative tension, the landing tool and the tubing hanger assembly become relatively nonrotatable and, in one example, upon application of an upwardly directed force of 6,000 pounds, the lock sleeve member may be disengaged from its locking position behind the lock ring 37 and may be moved to its upper position as shown in FIG. 1. When the lower extremity of the locking member 68 reaches the position as shown in FIG. 1 or FIG. 2, a further lifting force of about 12,000 pounds, in one example of the invention, will cause the bevel surfaces 81 on the lock ring and the conical surface 21 on the annular recess to interengage and to cam the lock ring into its contracted position so that it may pass through the upper end of the well casing portion 17. Thus, the tubing hanger may be readily removed from the well casing.

One of the important features of the present invention is that of lowering the tubing hanger assembly and landing tool in nonrotatable relation. The well casing, tubing hanger assembly 12, and landing tool 14 are so arranged that as the tubing hanger assembly is lowered onto its landing surface in the well casing the tubing hanger is automatically landed and supported in the well casing and locked therein. Transfer of weight of the tubing string to the well casing means automatically and at once places the annular packing resilient seal ring under compression and an annular seal is effected between the internal surfaces of the well casing and the external surfaces of the tubing hanger assembly. Thus landing, locking and sealing of the tubing hanger in a well casing means is accomplished virtually automatically and simultaneously.

Various changes and modifications may be made in the embodiment of the invention described above which fall within the spirit of this invention and all such changes and modifications coming within the scope of the appended claims are embraced thereby.

I claim:

1. In combination, a tubing hanger means, a well casing means, and a landing tool, comprising:

said casing means having a lock recess and having a landing surface spaced from said lock recess;

said tubing hanger means including a landing surface cooperable with the casing means landing surface, and a normally biased annular locking ring spaced from said tubing hanger landing surface;

a lock sleeve member cooperable with said tubing hanger means and having a conical surface and a plurality of circumferentially spaced locking elements spaced from said conical surface;

said landing tool and said lock sleeve member having engagement means for carrying said tubing hanger means in nonrotatable relation with respect thereto during landing of said tubing hanger on said casing means and during locking reception of said locking ring in said locking recess.

2. A combination as claimed in claim 1 wherein said spaced locking elements on said lock sleeve member are interposable between said annular locking ring and said tubing hanger means after said tubing hanger means has been locked and landed in said well casing means.

3. In a combination as claimed in claim 1 wherein said tubing hanger means includes an annular shoulder adjacent said lock ring and a landing surface member spaced from said shoulder;

and a resilient packing means between said annular shoulder and said landing surface member adapted to be compressed therebetween upon landing of said tubing hanger means and adapted to sealably engage said casing hanger means.

4. A combination as claimed in claim 1 wherein said engagement means resist relative rotation until said tubing hanger means has been landed on said landing surface with tubing hanger loads transferred to said casing means, until said locking ring is locked in said lock recess, and until weight of the landing string is imparted to said lock sleeve member whereby said engagement means is rotatable in one direction for release of the landing tool from the lock sleeve member and tubing hanger means.

5. A tubing hanger means for simultaneous landing and locking in a well member, such as a casing hanger, during longitudinal linear movement of the tubing hanger means relative to said well member, said tubing hanger means being adapted to be connected to a landing tool, comprising in combination:

a tubing hanger body provided with a landing surface;

a radially outwardly biased lock means spaced from said landing surface and carried by said hanger body;

lock sleeve means on said hanger body and adapted to cooperably engage a landing tool;

said hanger body landing surface and said lock means being adapted to be cooperable with landing and locking means on said well member for simultaneous landing and locking of said tubing hanger body with respect to said well member.

6. A tubing hanger means as claimed in claim 5 wherein said lock sleeve means includes:

a conical surface adapted to cooperate with said landing tool;

and spaced locking elements interposable between said lock means and said hanger body for holding said lock means in locked relation to said well member upon transfer of the weight of a tubing string carried by said tubing hanger body to the well member and upon imparting the weight of the landing string to said landing tool.

7. A tubing hanger means as claimed in claim 5 wherein said lock sleeve means includes an elongated sleeve portion receiving said tubing hanger body and adapted to have threaded engagement with said landing tool, said threaded engagement being non-rotatable while said tubing hanger body and said landing tool are in tension under conditions wherein said tubing hanger supports a tubing string prior and during landing of the hanger body in said well member.

8. A tubing hanger means as claimed in claim 5 wherein said lock sleeve means is provided with a conical surface adapted for engagement by said landing tool for transferring weight of a landing string to said lock sleeve means;

said lock sleeve means having lock elements driven between said lock means and said hanger body upon such weight transfer of said landing string to said sleeve means.

9. In a tubing hanger means as claimed in claim 5 including a landing tool;

threaded engagement means between said landing tool and said lock sleeve means;

said threaded engagement being non-rotatable under conditions of tension relative to said lock sleeve member and said landing tool.

10. In a tubing hanger means as claimed in claim 9 wherein said threaded engagement provides rotation of said landing tool in one direction relative to said locking sleeve means when said landing tool and said locking sleeve means are under a condition of compression for release of said landing tool from said tubing hanger means.

11. A tubing hanger means as claimed in claim 4 including a support ring on said tubing hanger body providing said landing surface;

an annular packing means having one face supported on said support ring;

and means on said tubing hanger body contacting the opposite face of said packing means whereby said packing means is compressible therebetween upon landing of said tubing hanger body and for sealably engaging said well member.

12. In a method of installing and retrieving a tubing hanger having a compressible seal ring in a casing means including the steps of:

connecting a tubing string to a tubing hanger;

threadedly connecting a landing tool to said tubing hanger in non-rotatable relative relation with threaded engagement therebetween under tension;

lowering said tubing hanger and landing tool in said non-rotatable relation by a landing string;

simultaneously landing, locking, and sealing said tubing hanger in said casing while maintaining said non-rotatable relation;

retrieving said landing tool;

said tubing hanger being adapted to be unlocked and retrieved from said casing.

13. In a method as claimed in claim 12 including the step of imposing weight of said landing string to said landing tool and upon said tubing hanger for securing said locked condition of said tubing hanger in said casing, and for urging a seal ring into sealing engagement with side walls of said casing in spaced relation to said landing surface.

14. Method as claimed in claim 12 including retrieving said tubing hanger by threadedly re-engaging said landing tool with said tubing hanger by righthand relative rotation;

applying an upwardly directed force to said landing string and landing tool to place said threaded engagement under relative tension whereby said landing tool and tubing hanger are relatively non-rotatable;

applying an additional upwardly directed force to unlock said tubing hanger from said casing for retrieval of said tubing hanger.

15. In a method of landing and simultaneously locking a tubing hanger in a casing means by relative linear movement therebetween including the steps of:

connecting a tubing string to a tubing hanger;

connecting a landing tool to said tubing hanger in non-rotatable relative relation;

lowering said tubing hanger and landing tool by a landing string;

simultaneously landing said tubing hanger on the landing surface in said casing and locking said tubing hanger in said casing in landed position;

releasing said landing tool from said tubing hanger by imposing a condition of compression between said landing tool and said tubing hanger to permit rotation of said landing tool in only one direction relative to said tubing hanger.

* * * * *